US009617876B2

(12) United States Patent
Dietel et al.

(10) Patent No.: US 9,617,876 B2
(45) Date of Patent: Apr. 11, 2017

(54) ADJUSTABLE CAMSHAFT

(71) Applicant: THYSSENKRUPP PRESTA TECCENTER AG, Eschen (LI)

(72) Inventors: Uwe Dietel, Lichtentanne (DE); Michael Kunz, Chemnitz (DE); Bernd Mann, Zschopau (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 0 days.

(21) Appl. No.: 14/417,737

(22) PCT Filed: Jul. 19, 2013

(86) PCT No.: PCT/EP2013/065299
§ 371 (c)(1),
(2) Date: Jan. 27, 2015

(87) PCT Pub. No.: WO2014/016215
PCT Pub. Date: Jan. 30, 2014

(65) Prior Publication Data

US 2015/0152750 A1 Jun. 4, 2015

(30) Foreign Application Priority Data

Jul. 27, 2012 (DE) ..... 10 2012 106 856

(51) Int. Cl.
*F16H 53/04* (2006.01)
*F01L 1/047* (2006.01)
*F01L 1/344* (2006.01)

(52) U.S. Cl.
CPC ..... *F01L 1/047* (2013.01); *F01L 1/344* (2013.01); *F01L 2001/0475* (2013.01); *F01L 2001/0476* (2013.01); *Y10T 74/2102* (2015.01)

(58) Field of Classification Search
CPC ..... F01L 1/047; F01L 2001/34423; F01L 2001/0473; F01L 2001/0475
See application file for complete search history.

(56) References Cited

U.S. PATENT DOCUMENTS 2,151,834 A * 3/1939 Bugatti ..... F01L 1/04 123/90.31
5,158,049 A * 10/1992 Neumann ..... F01L 1/047 123/90.17

(Continued)

FOREIGN PATENT DOCUMENTS

DE 10020119 A1 10/2001
DE 102005062207 A1 6/2007

(Continued)

OTHER PUBLICATIONS

German Language International Search Report for International patent application No. PCT/EP2013/065299; mailing date Nov. 6, 2013.

(Continued)

*Primary Examiner* — Vicky Johnson
(74) *Attorney, Agent, or Firm* — thyssenkrupp North America, Inc.

(57) ABSTRACT

The present invention relates to an adjustable camshaft for the valve gear of an internal combustion engine having an outer shaft, on which at least one first cam is arranged which is connected fixedly to said outer shaft so as to rotate with it, and having an inner shaft which extends through the outer shaft and to which at least one second cam is connected fixedly so as to rotate with it and is mounted rotatably on the outer shaft, and it being possible for oil to be conducted from a gap between the outer shaft and the inner shaft through an oil duct in the outer shaft into the region between the second cam and the outer shaft. According to the invention, the (Continued)

second cam is sealed at least partially against the outer shaft by means of at least one sealing element.

14 Claims, 3 Drawing Sheets

(56) References Cited

U.S. PATENT DOCUMENTS

| | | | | |
|---|---|---|---|---|
| 7,610,890 | B2 | 11/2009 | Lettmann et al. | |
| 2002/0056195 | A1* | 5/2002 | Bloecker | B21D 26/033 29/888.1 |
| 2008/0257290 | A1* | 10/2008 | Lettmann | F01L 1/047 123/90.17 |
| 2010/0170458 | A1 | 7/2010 | Pluta et al. | |
| 2011/0265756 | A1* | 11/2011 | Flender | F01L 1/047 123/193.5 |

FOREIGN PATENT DOCUMENTS

| | | | |
|---|---|---|---|
| DE | 202005021715 | U1 | 7/2009 |
| EP | 0324498 | A1 | 7/1989 |
| EP | 0931604 | A1 | 7/1999 |
| EP | 2634385 | A1 | 9/2013 |

OTHER PUBLICATIONS

English Translation of International Search Report for International patent application No. PCT/EP2013/065299; mailing date Nov. 6, 2013.
German Language Written Opinion of the International Search Authority for International patent application No. PCT/EP2013/065299; mailing date Nov. 6, 2013.
English Translation of the Written Opinion of the International Search Authority for International patent application No. PCT/EP2013/065299; mailing date Nov. 6, 2013.
English translation of abstract of EP 0324498 (A1).
English translation of abstract of EP 0931604 (A1).
English translation of abstract of DE 102005062207 (A1).
English translation of abstract of DE 10020119 (A1).
English translation of abstract of EP 2634385 (A1).

* cited by examiner

ADJUSTABLE CAMSHAFT

CROSS REFERENCE TO RELATED APPLICATIONS

This application is a U.S. National Stage Entry of International Patent Application Serial Number PCT/EP2013/065299, filed Jul. 19, 2013, which claims priority to German patent application no. DE 102012106856.9, filed Jul. 27, 2012.

FIELD

The present invention relates to an adjustable camshaft for the valve gear of an internal combustion engine having an outer shaft, on which at least one first cam is arranged which is connected fixedly to said outer shaft so as to rotate with it, and having an inner shaft which extends through the outer shaft and to which at least one second cam is connected fixedly so as to rotate with it and is mounted rotatably on the outer shaft, and it being possible for oil to be conducted from a gap between the outer shaft and the inner shaft through an oil duct in the outer shaft into the region between the second cam and the outer shaft.

BACKGROUND

DE 20 2005 021 715 U1 has disclosed an adjustable camshaft for the valve gear of an internal combustion engine having an outer shaft, on which first cams are arranged which are arranged fixedly with said outer shaft so as to rotate with it, and an inner shaft extending through the outer shaft, to which inner shaft second cams are connected fixedly so as to rotate with it. The second cams are mounted on the outer side on the outer shaft. If the inner shaft is rotated with respect to the outer shaft in terms of its phase position, the control position of the first cams is displaced with respect to the control position of the second cams. A cam adjusting device which can be activated by way of compressed oil is arranged on the camshaft in order to change the phase position of the inner shaft with respect to the phase position of the outer shaft.

Oil is conducted in the radial gap between the inner shaft and the outer shaft, which oil is fed to the gap at a positive pressure. In order to supply the plain bearing seat of the second cams on the outer side of the outer shaft with oil, the outer shaft has at least one oil duct in the region of the second cams, through which oil duct oil is conducted out of the gap into the region between the second cam and the outer shaft. Here, the oil duct is formed by pin openings in the outer shaft, through which pin openings a pin is guided for coupling the second cam to the inner shaft.

The oil can be introduced via a camshaft bearing into the gap between the inner and the outer shaft, there being a plurality of camshaft bearings for mounting the adjustable camshaft in the cylinder head. One exemplary embodiment of DE 20 2005 021 715 U1 discloses a camshaft bearing which is arranged so as to adjoin a cam adjusting device, by way of which the inner shaft can be rotated with respect to the outer shaft in terms of its phase position. It is known here that the oil is conducted into the gap via the camshaft bearing which adjoins the cam adjusting device, which results in the disadvantage, however, that the configuration of the camshaft bearing adjacently with respect to the cam adjusting device has to be of complicated construction, since only a limited amount of installation space is available. The arrangement which is shown therefore does not make it possible to supply the cam adjusting device with oil from the gap between the inner shaft and the outer shaft, and the oil supply has to be configured separately.

The oil supply of the gap between the inner shaft and the outer shaft can usually take place via an outer camshaft bearing which is arranged so as to adjoin the cam adjusting device and mounts the camshaft in the cylinder head. The cam adjusting device can therefore be supplied directly via the compressed oil which is fed in, at the same time the gap between the inner shaft and the outer shaft being fed with compressed oil. This disadvantageously results in a pressure loss in the case of every second cam which is connected to the inner shaft, since a considerable outflow of compressed oil has to be determined through the oil duct into the region between the outer side of the outer shaft and the second cam. As a consequence, the oil supply of individual adjusting cams becomes less satisfactory as the distance increases from the infeed point of the oil via the camshaft bearing which adjoins the cam adjusting device. As a further consequence, the oil has to be fed into the gap between the inner shaft and the outer shaft at a plurality of locations.

If the oil is fed in via a camshaft bearing which is at a distance from the cam adjusting device, a pressure loss results over the axial course of the gap at every adjusting cam, with the result that the cam adjusting device is no longer supplied sufficiently with compressed oil from the gap between the inner shaft and the outer shaft.

BRIEF DESCRIPTION OF THE DRAWINGS

The present disclosure is described in detail below with reference to the attached drawing figure, wherein.

DETAILED DESCRIPTION

Figure 1A:
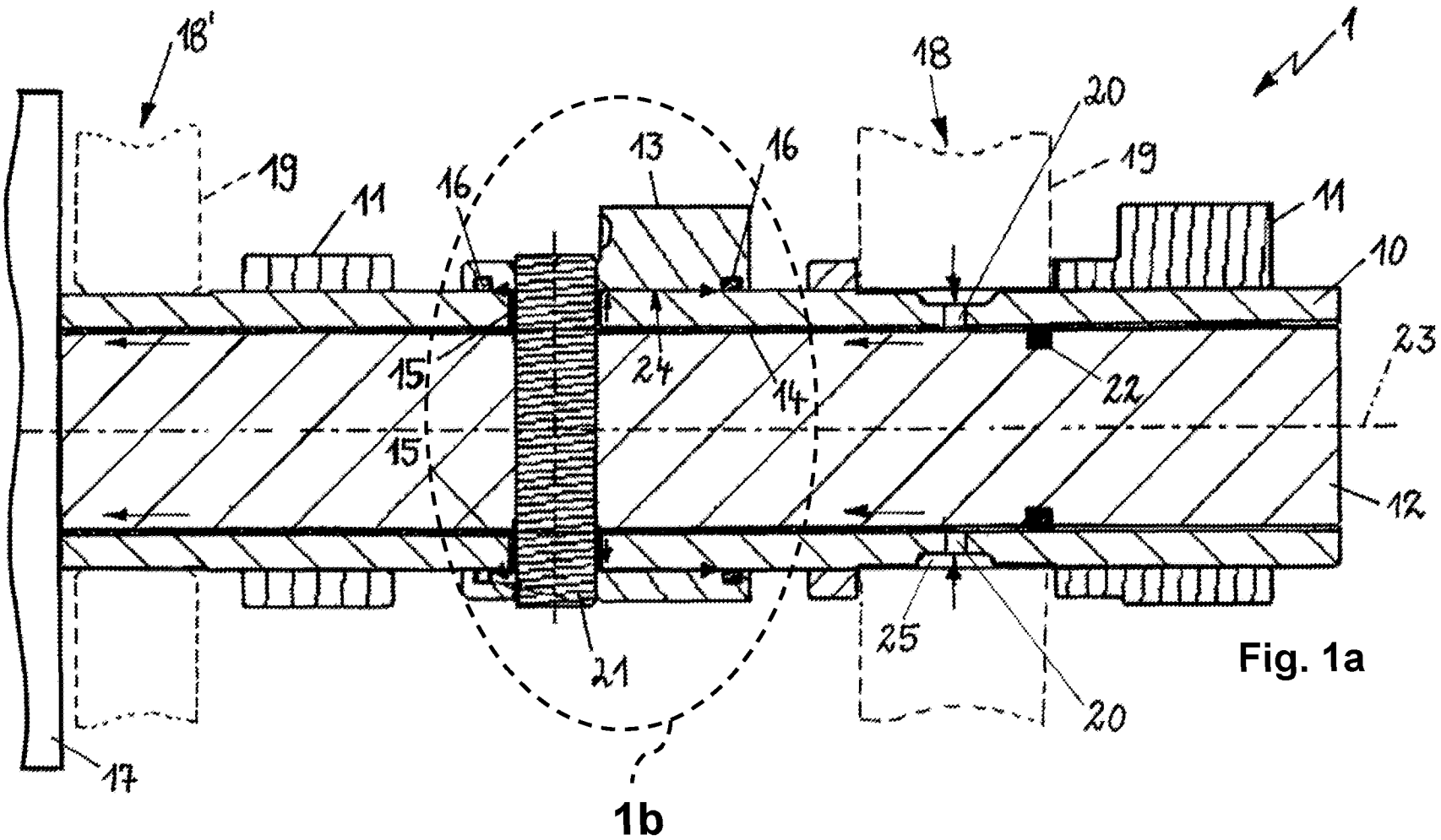
FIG. 1*a* is a side cross-sectional view of an embodiment of an adjustable camshaft of the present disclosure.

The disadvantages of the prior art result in the object of the invention, namely to provide an adjustable camshaft with an improved oil supply. In particular, the object arises to provide an improved feed of oil into the gap between the inner shaft and the outer shaft; furthermore, a supply which is sufficient and as homogeneous as possible of all the cams which are received rotatably on the outer shaft should be made possible. Finally, the further object of the invention arises to provide the feed of oil into the gap between the inner shaft and the outer shaft at a more suitable location, in order at the same time to sufficiently supply the cam adjusting device with oil from the gap.

This object is achieved proceeding from an adjustable camshaft as claimed in claim 1 in conjunction with the characterizing features. Advantageous developments of the invention are specified in the dependent claims.

The invention includes the technical teaching that the second cam is sealed at least partially against the outer shaft by means of at least one sealing element.

The invention proceeds from the concept of minimizing as far as possible the outflow of oil from the gap between the inner shaft and the outer shaft for the supply of oil of the region between the rotatable second cams and the outer side of the outer shaft, with the result that a sufficient quantity of oil can pass to the cam adjusting device even in the case of a feed location of the oil into the gap, which feed location is at a distance from the cam adjusting device. Nevertheless, lubrication of the mounting of the movable cam on the outer shaft can be maintained.

As a result of the embodiment according to the invention of the adjustable camshaft, a cam adjusting device can be arranged on the end side of the camshaft in order to adjust the phase between the inner shaft and the outer shaft, which cam adjusting device can be supplied with a sufficient quantity of oil from the gap. The outer shaft of the camshaft can be mounted by way of at least one camshaft bearing in the cylinder head, a plurality of camshaft bearings which are spaced apart from one another preferably being provided, in order to mount the camshaft completely over its length. Here, oil can be fed via at least one oil feed bore from one of the camshaft bearings into the gap.

According to one particularly advantageous variant, the camshaft bearing can be arranged with the oil feed bore for feeding oil into the gap on a side of the adjustable second cam, which side faces away from the cam adjusting device, with the result that the oil supply of the cam adjusting device can take place past the adjustable second cam. Here, the adjustable second cam can form the first adjusting cam which adjoins the cam adjusting device, and the pressure loss of the oil in the gap between the inner shaft and the outer shaft is so low or is even eliminated by way of the arrangement according to the invention of sealing elements between the second cam and the outer side of the outer shaft, such that sufficient oil can pass to the cam adjusting device even if oil is fed via a camshaft bearing which is arranged at a distance. For example, the feeding of oil can take place via an end camshaft bearing which mounts the camshaft in the cylinder head on that side of said camshaft which faces away from the cam adjusting device. As a result of the substantially pressure-tight configuration of the mounting of the rotatable second cam on the outer side of the outer shaft, the pressure loss over the length of the camshaft is so minimal that sufficient oil can pass to the cam adjusting device even in the case of said feeding of oil at a distance.

According to one particularly advantageous embodiment of the adjustable camshaft, a camshaft bearing can be arranged between the adjustable second cam which forms the first adjusting cam adjacently with respect to the cam adjusting device, and the cam adjusting device itself, which camshaft bearing is configured so as to be closed with respect to the gap between the inner shaft and the outer shaft. The camshaft bearing which adjoins the cam adjusting device therefore forms a simple camshaft bearing without an oil supply of complicated construction for feeding oil into the gap between the inner shaft and the outer shaft. In particular, the arrangement, adjacently with respect to the cam adjusting device, of a bearing of simple configuration for rotatably receiving the camshaft in the cylinder head simplifies the structural configuration of the connection between the cam adjusting device and the inner shaft and the outer shaft.

In order to connect the second cam which can be rotated on the outer shaft to the inner shaft, a pin can be provided which extends transversely with respect to the rotational axis of the camshaft. Here, the pin can be pressed into the inner shaft, with the result that the ends of the pin extend through the outer shaft into the second cam. If the inner shaft rotates with respect to the outer shaft, the pin pivots in pin openings which are made in the outer shaft and extend in an elongate manner in the circumferential direction. The pressurized oil in the gap between the inner shaft and the outer shaft fills the pin openings in the process and passes via them into the region between the rotatable second cam and the outer shaft. As a consequence, the oil duct is formed for conducting the oil from the gap into the region by means of pin openings. In particular, two pin openings which lie opposite one another can be made in the outer shaft, and the pin is received in the second cam via both ends diametrically with respect to the rotational axis of the camshaft.

According to one development of the adjustable camshaft, two sealing elements can be provided which seal the region between the second cam and the outer shaft toward both axial edge sides. For example, a first sealing element can seal the first edge region in a first axial direction of the camshaft, and a further sealing element can seal the second edge region in a second axial direction of the camshaft. As a consequence, the region between the two sealing elements is supplied with oil via the oil duct. The sealing elements can be introduced, for example, on the inner side in a cam bore in the adjustable cam, or the sealing elements are inserted in the outer side of the outer shaft, and a plain bearing face for receiving the second cam on the outer side of the outer shaft is formed between the two sealing elements.

The sealing element which seals the second cam against the outer shaft can be formed from steel, from a non-ferrous metal or, for example, from a plastic, such as PTFE, POM or from rubber. In particular, the sealing element can be configured as an O-ring or can have a configuration which is slotted, that is to say which is not closed in an annular manner. The second cam which is received on the outer shaft and can be rotated on the latter has a cam bore, through which the outer shaft runs, and the region between the second cam and the outer shaft is formed between the cam bore and the outer side of the outer shaft. The sealing element can therefore be seated on the inner side in the cam bore or the sealing element is arranged laterally on the second cam, with the result that said sealing element seals the cam bore against the outer side of the outer shaft. The sealing element can also be configured in one piece with the cam, for example formed from an inwardly configured extension or section of the cam bore, or the sealing element is formed by a metal ring which is inserted on the inner side in the cam bore, for example formed by a brass ring.

According to a further improvement of the camshaft according to the invention, at least one sealing ring can be arranged between the inner shaft and the outer shaft, the arrangement of a first sealing ring being provided on that side of the camshaft bearing which faces away from the arrangement of the cam adjusting device, which camshaft bearing is configured with at least one oil feed bore. Here, the sealing ring can be configured in such a way that oil in the gap between the inner shaft and the outer shaft cannot pass the sealing ring in the axial direction. A particularly advantageous arrangement of the sealing ring arises if it is provided on that side of the camshaft bearing which faces away from the arrangement of the cam adjusting device, which camshaft bearing is configured with at least one oil feed bore. A plurality of fluidically separated supply segments can therefore be produced distributed over the length of the camshaft for supplying with oil from the gap between the inner shaft and the outer shaft, the segment which faces the cam adjusting device at the same time supplying the cam adjusting device itself.

It is furthermore advantageous that the sealing element can be configured in such a way that a small oil flow remains from the region between the second cam and the outer shaft into the installation surroundings of the camshaft, it being possible, for example, for the installation surroundings to be formed by the receiving space in the cylinder head of an internal combustion engine. However, the oil flow through the sealing elements can be of such a low magnitude that, nevertheless, a sufficient oil transport is maintained through the gap from the at least one oil feed bore of a camshaft bearing to the cam adjusting device.

For example, the sealing element can comprise a metal seal and can have a residual gap between the cam bore in the second cam and the outer side of the outer shaft, through which residual gap the small oil flow is generated. This ensures that an oil exchange takes place in the sliding gap between the cam bore and the outer shaft, in order to supply said sliding gap continuously with fresh oil.

Further embodiments will be described in greater detail in the following text together with the attached drawing figures.

Figure 1B:
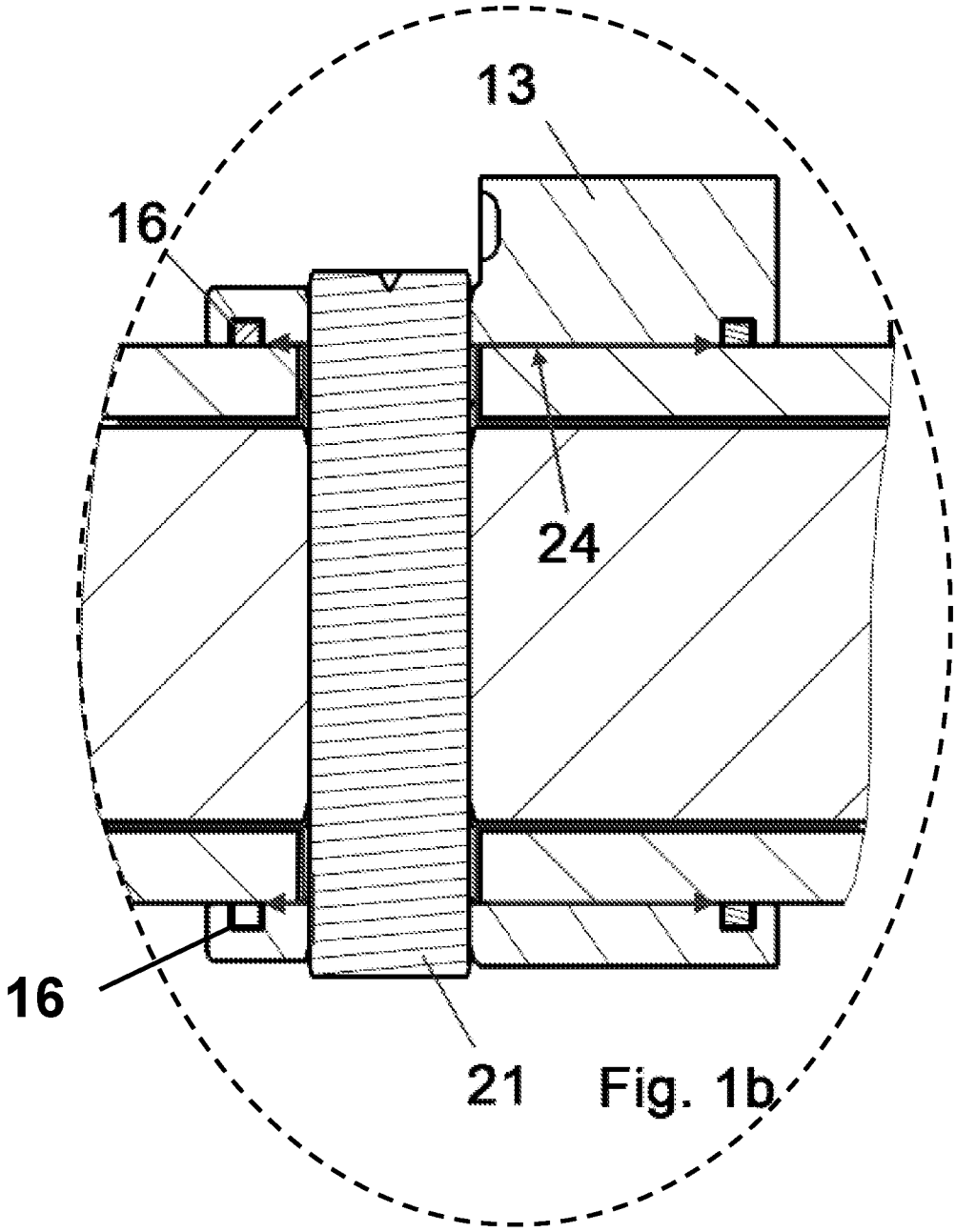
FIG. 1*b* is an enlarged detail view of the adjustable camshaft of FIG. 1 showing a sealing element that is slotted, such that the sealing element is not closed in an annular manner, wherein the sealing element shown in FIG. 1*b* is sectioned through an upper portion as shown by the cross-hatching, but a slot or radial opening through the sealing element is located at the bottom of the view and shows a solid end face of the slotted sealing element, as shown by the absence of cross-hatching.
Figure 1C:
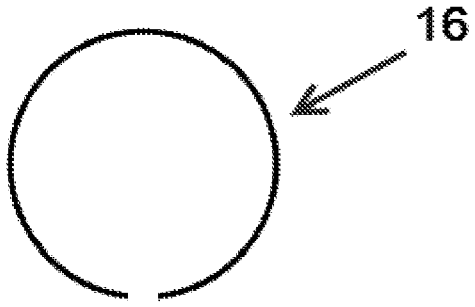
FIG. 1*c* is a plan schematic view of an embodiment of the slotted sealing element of FIGS. 1*a* and 1*b*.
Figure 2:
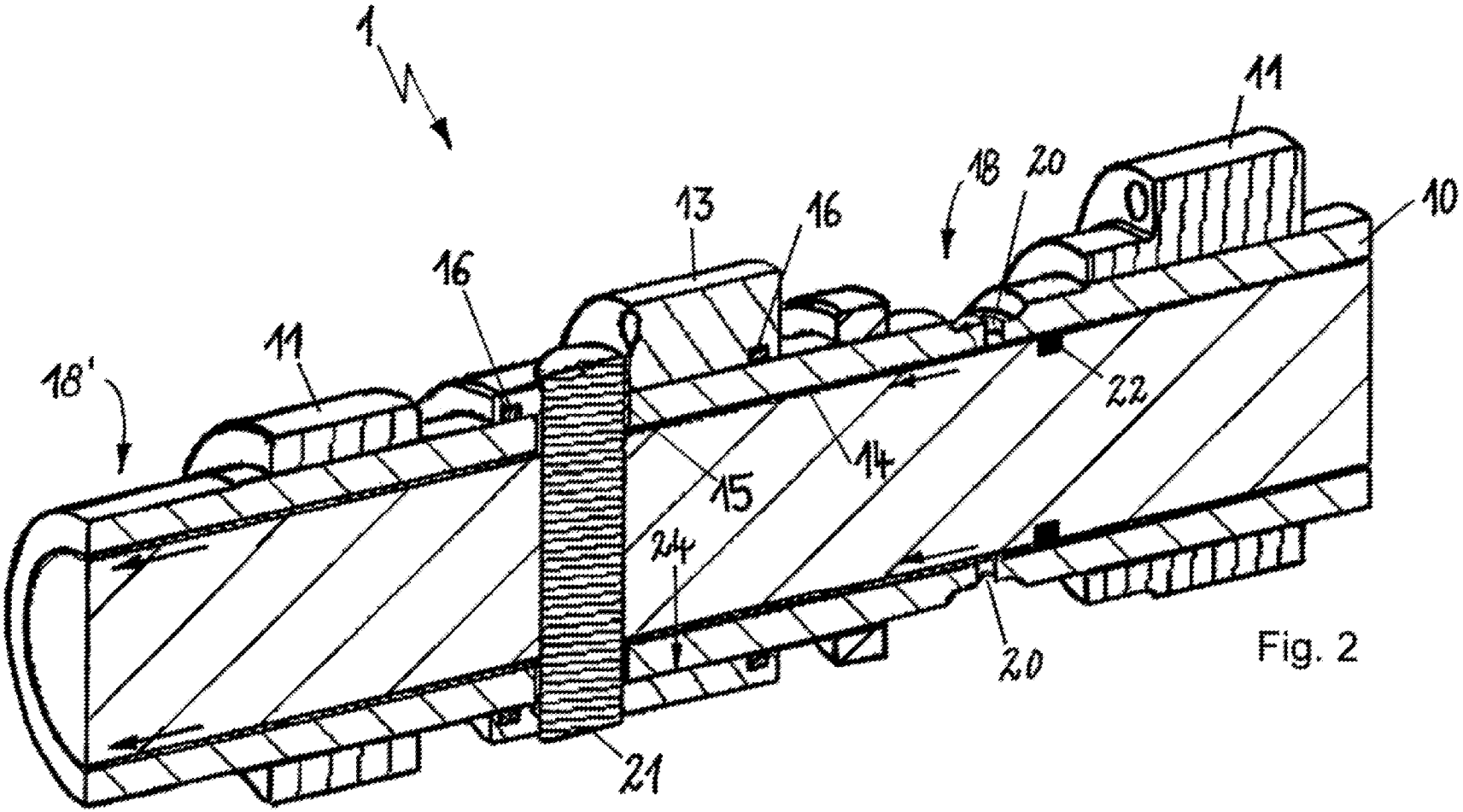
FIG. 2 is a perspective view of the adjustable camshaft of FIG. 1.

FIGS. 1 and 2 show one exemplary embodiment of an adjustable camshaft 1 for the valve gear of an internal combustion engine, FIG. 1 showing the camshaft 1 in cross section and in addition showing the arrangement of a cam adjusting device 17. Furthermore, FIG. 1 diagrammatically shows two camshaft bearings 18, 18' which, together with a part of the cylinder head 19 which is shown, are configured as plain bearings.

The camshaft 1 has an outer shaft 10 on which two first cams 11 are arranged in the detail which is shown, the first cams 11 being connected fixedly to the outer shaft 10 so as to rotate with it, for example by said first cams 11 being pressed onto the outer shaft or being welded to the outer shaft. An inner shaft 12 extends through the outer shaft 10, and a second cam 13 is shown which is connected fixedly via a pin 21 to the inner shaft 12 so as to rotate with it. The second cam 13 has a cam bore 24, through which the outer shaft 10 extends, with the result that the second cam 13 is mounted rotatably on the outer shaft 10. If the inner shaft 12 rotates with respect to the outer shaft 10, by the cam adjusting device 17 being activated, the phase position of the second cam 13 is displaced with respect to the phase position of the first cam 11. As a result, the control times of a valve gear of the internal combustion engine can be varied, while the camshaft 1 rotates about its rotational axis 23.

An annular gap 14 is formed between the outer shaft 10 and the inner shaft 12, and the gap 14 is filled with pressurized oil. The oil is guided via a camshaft bearing 18 into the gap 14, and a first camshaft bearing 18 is shown for mounting the camshaft 1 in the cylinder head 19, which first camshaft bearing 18 is arranged at a distance from the cam adjusting device 17, and a further camshaft bearing 18' is arranged so as to adjoin the cam adjusting device 17. The camshaft bearing 18 which is arranged at a distance from the cam adjusting device 17 has oil feed bores 20, through which oil is conducted into the gap 14 between the outer shaft 10 and the inner shaft 12. Two oil feed bores 20 which lie opposite one another and are shown in section are shown here, and a plurality of oil feed bores 20 can be provided distributed over the circumference, which oil feed bores 20 are connected fluidically to one another by way of an annular gap 25. The oil which is introduced into the gap 14 can flow in the direction of the cam adjusting device 17, with the result that the oil passes the region of the second cam 13 without an appreciable pressure loss and at the same time supplies said region with oil for lubrication.

Oil ducts 15 are formed by the pin openings which are made in the outer shaft 10 and through which the end sides of the pin 21 are guided, and oil can be conducted through the oil ducts 15 from the gap 14 into the region between the second cam 13 and the outer shaft 10. Said region arises between the outer side of the outer shaft 10 and the cam bore 24 in the second cam 13.

In order to prevent oil from passing from the region between the second cam 13 and the outer shaft 10 into the installation surroundings of the camshaft 1, which results in a pressure loss in the gap 14 when the oil passes through the gap 14 past the second cam 13, it is provided according to the invention that the second cam 13 is sealed at least partially against the outer shaft 10 by means of sealing elements 16. This achieves a situation where no pressure loss or only a small pressure loss is produced when the oil passes past the second cam 13, and the cam adjusting device 17 can be supplied with oil by a camshaft bearing 18 which is arranged at a distance therefrom according to the arrangement which is shown. The sealing elements 16 are shown as O-rings by way of example and are inserted on the inner side in the cam bore 24 in the second cam 13.

In order to prevent an outflow of the oil through the gap 14 into the further course of the camshaft 1, a sealing ring 22 is arranged in the region of the camshaft bearing 18 adjacently with respect to the oil feed bores 20, which sealing ring 22 is arranged in the inner shaft 12 and can be formed, for example, by way of an O-ring. As a result, an oil supply system is provided over that section of the camshaft 1 which is shown, which oil supply system is based on oil being fed into the gap 14 via oil feed bores 20 which are arranged at a distance from the cam adjusting device 17, which oil subsequently passes the arrangement of the second cam 13 and supplies the cam adjusting device 17 which is arranged on the end side of the camshaft 1 with oil, as is indicated by way of arrows.

In terms of its embodiment, the invention is not restricted to the preferred exemplary embodiment which is specified in the preceding text. Rather, a number of variants are conceivable which make use of the described solution even in the case of embodiments of a fundamentally different type. All of the features and/or advantages which are apparent from the claims, the description or the drawings, including structural details or spatial arrangements, can be essential to the invention both per se and in a very wide range of combinations.

The invention claimed is:

1. An adjustable camshaft for a valve gear of an internal combustion engine, comprising:

a rotatable outer shaft defining an interior central bore there through along a longitudinal axis of said outer shaft, and defining an oil duct through a sidewall of said outer shaft;

at least one first cam fixedly coupled onto said outer shaft and configured to rotate with said outer shaft;

an inner shaft rotatably disposed in and extending through said interior central bore of said outer shaft, and defining a gap between said inner shaft and said outer shaft;

at least a second cam disposed on said outer shaft and defining a lubrication region between said second cam and said outer shaft, said second cam configured to be rotatable with respect to said outer shaft about said longitudinal axis, said second cam further being fixedly coupled to said inner shaft and configured to rotate with said inner shaft, said inner and outer shafts being configured to permit oil to flow through said gap between said inner and outer shafts, through said oil duct in said outer shaft and into said lubrication region; and at least a first sealing element disposed between said outer shaft and said second cam and configured to provide at least a partial seal between said second cam and said outer shaft.

2. The adjustable camshaft of claim 1, further comprising a cam adjusting device configured to be supplied with oil from the gap between said inner shaft and said outer shaft.

3. The adjustable camshaft of claim 2, wherein said outer shaft is configured to permit oil flow from an oil feed bore to said cam adjusting device through said gap between said inner and outer shafts.

4. The adjustable camshaft of claim 2, further comprising at least a first camshaft bearing disposed about said outer shaft and configured to mount said outer shaft in a cylinder head of the internal combustion engine.

5. The adjustable camshaft of claim 4, wherein said outer shaft further defines at least one oil feed bore through said sidewall of said outer shaft, and wherein said outer shaft is configured to have oil fed from said camshaft bearing through said at least one oil feed bore and into said gap between said inner and outer shafts.

6. The adjustable camshaft of claim 5, further comprising at least one sealing ring disposed between said inner shaft and said outer shaft and axially positioned on an opposite side of said first camshaft bearing than said cam adjusting device.

7. The adjustable camshaft of claim 4, wherein said first camshaft bearing and oil feed bore are disposed on a side of said second cam opposite to said cam adjusting device and are configured to supply oil to the cam adjusting device from said side of said second cam opposite to said cam adjusting device.

8. The adjustable camshaft of claim 7, further comprising a second cam shaft bearing disposed between said second cam and said cam adjusting device, and configured to be closed for the passage of oil into said gap.

9. The adjustable camshaft of claim 1, wherein said second cam is coupled to said inner shaft by a pin that extends through at least one pin opening defined in said outer shaft, and wherein said oil duct for permitting oil to flow into the lubricating region between said second cam and said outer shaft is formed by said pin opening.

10. The adjustable camshaft of claim 1, further comprising at least a second sealing element disposed between said outer shaft and said second cam, and configured to provide at least a partial seal between said second cam and said outer shaft, wherein said first and second sealing elements are disposed at opposing axial ends of said second cam.

11. The adjustable camshaft of claim 1, wherein said first sealing element is made from at least one of steel, a non-ferrous metal, plastic, or rubber.

12. The adjustable camshaft of claim 1, wherein said first sealing element is in the shape of an O-ring.

13. The adjustable camshaft of claim 1, wherein said first sealing element is configured to permit a small amount of oil to flow from the lubricating region between said second cam and said outer shaft into an outer installation area surrounding said camshaft.

14. The adjustable camshaft of claim 1, wherein said first sealing element is a slotted sealing element that is not closed in an annular manner.

* * * * *